US008587490B2

(12) United States Patent
Niver et al.

(10) Patent No.: US 8,587,490 B2
(45) Date of Patent: Nov. 19, 2013

(54) LOCALIZED WAVE GENERATION VIA MODEL DECOMPOSITION OF A PULSE BY A WAVE LAUNCHER

(75) Inventors: Edip Niver, Mountainside, NJ (US); Mohamed Salem, Harrison, NJ (US); Aladin Hassan Kamel, Cairo (EG)

(73) Assignee: New Jersey Institute of Technology, Newark, NJ (US)

( * ) Notice: Subject to any disclaimer, the term of this patent is extended or adjusted under 35 U.S.C. 154(b) by 1149 days.

(21) Appl. No.: 12/510,040

(22) Filed: Jul. 27, 2009

(65) Prior Publication Data

US 2011/0018650 A1 Jan. 27, 2011

(51) Int. Cl.
*H01Q 3/00* (2006.01)

(52) U.S. Cl.
USPC ..... 343/762; 343/772

(58) Field of Classification Search
USPC ..... 343/762, 772, 778, 786
See application file for complete search history.

(56) References Cited

U.S. PATENT DOCUMENTS

| | | | | |
|---|---|---|---|---|
| 5,036,332 | A | 7/1991 | Thomas | |
| 6,137,450 | A | 10/2000 | Bhattacharyya | |
| 6,323,819 | B1 | 11/2001 | Ergene | |
| 6,353,417 | B1 * | 3/2002 | Yuanzhu | 343/785 |
| 6,661,390 | B2 * | 12/2003 | Gau et al. | 343/786 |
| 2008/0099692 | A1 | 5/2008 | Poreira et al. | |

FOREIGN PATENT DOCUMENTS

EP 1235296 A1 8/2002

OTHER PUBLICATIONS

Nathan Marcuvitz, Waveguide Handbook, IEEE Electromagnetic Waves Series, 21, 1986, McGraw-Hill, New York, USA.

Navy Electricity and Electronics Training Series, Module 11—Microwave Principle, Nonresident Training Course, Sep. 1998, pp. 1-92, USA.

Poitau, G. et al., Analysis of MIMO Capacity in Waveguide Environments Using Practical Antenna Structures for Selective Mode Excitation, Canadian Conference on Electrical and Computer Engineering, IEEE, 2004, vol. 1, p. 349-352.

Shaarawi, A.M. et al., Aperture Synthesis of Time-Limited X Waves and Analysis of their Propagation Characteristics, Journal of Acoustical Society of America, May 1998, vol. 103, Issue 4, pp. 2287-2295.

J.N. Brittingham, "Focus Wave Modes in Homogeneous Maxwell Equations: Transverse Electric Mode," J. Appl. Phys. 54, p. 1179 (1983).

R.W. Ziolkowski, "Exact Solutions of the Wave Equation With Complex Source Locations," J. Math. Phys. 26, p. 861 (1985).

J. Y. Lu and J. F. Greenleaf, "Nondiffracting X Waves—Exact Solutions to Free Space Scalar Wave Equation and Their Finite Aperture Realization," IEEE Transactions on Ultrasonics, Ferroelectics and Frequency Control, Jan. 1992, vol. 39, No. 1, p. 19.

R.W. Ziolkowski, "Localized Wave Physics and Engineering," Phys. Rev. A 1991, vol. 44, pp. 3960-3984.

R.W. Ziolkowski and D.K. Lewis, "Verification of the Localized Wave Transmission Effect", J. Appl. Phys. Dec. 1990, vol. 68, pp. 6083-6096.

D. Power, et al., "Spherical Scattering of Superpositions of Localized Waves", Phys. Rev. 1993, vol. 48, pp. 1410-1417.

(Continued)

*Primary Examiner* — Tan Ho
(74) *Attorney, Agent, or Firm* — Turk IP Law, LLC

(57) ABSTRACT

Implementations for exciting two or more modes via modal decomposition of a pulse by a wave launcher are generally disclosed.

15 Claims, 8 Drawing Sheets

(56) References Cited

OTHER PUBLICATIONS

S. Monk, et al., "The Generation Bessel Beams at Millimeter-Wave Frequencies by Use of an Axicon," Optics Communications, 1999, pp. 213.
D. Mugnai et al., "Observation of Superluminal Behaviours in Wave Propagation," Phys. Rev. Lett., 2000, vol. 84, pp. 4830-4833.
J. Salo, et al., "Millimetre-Wave Bessel Beams Using Computer Holograms," Electronics Letters, Jun. 2001, vol. 37 (13), pp. 834.
P.Saari and K.Reivelt, "Evidence of X-Shaped Propagation Invariant Localized Light Waves," Phys. Rev. Lett. 1997, vol. 79, p. 4135-4138.
K. Reivelt and P. Saari, "Optical Generation of Focus Wave Modes," J. Opt. Soc. Am. 2000 A 17, p. 1785.
International Search Report and Written Opinion for International Application No. PCT/US2010/038321 mailed on Sep. 21, 2010.
International Preliminary Report on Patentability for International Application No. PCT/US2010/038321 dated Jan. 31, 2012.

* cited by examiner

LOCALIZED WAVE GENERATION VIA MODEL DECOMPOSITION OF A PULSE BY A WAVE LAUNCHER

BACKGROUND

Localized waves, which may also be referred to as non-diffractive waves, are beams and/or pulses that may be capable of resisting diffraction and/or dispersion over long distances even in guiding media. Predicted to exist in the early 1970s and obtained theoretically and experimentally as solutions to the wave equations starting in 1992, localized waves may be utilized in applications in various fields where a role is played by a wave equation, from electromagnetism extending to acoustics and optics. In electromagnetic areas, localized waves may be utilized, for instance, for secure communications, and with higher power handling capability in destruction and elimination of targets.

Localized waves include slow-decaying and low dispersing class of Maxwell's equations solutions. One such solution is often referred to as focus wave modes (FWMs). Such FWMs may be structured as three dimensional pulses that may carry energy with the speed of light in linear paths. However without an infinite energy input, finite energy solutions of a FWMs type may result in dispersion and loss of energy. To counteract such dispersion and loss of energy, a superposition of FWMs may permit finite energy solutions of a FWMs type to result in slow-decaying solutions, which may be characterized by high directivity. Such FWMs characterized by high directivity may be referred to as directed energy pulse trains (DEPTs). Another class of non-diffracting solutions to Maxwell's equations may be referred to as XWaves. Such XWaves were so named due to their shape in the plane through their axes. XWaves may travel to infinity without spreading provided that they are generated from infinite apertures. This family of Maxwell's equations solutions, including FWMs, DEPTs, and/or XWaves, thus may have an infinite total energy but finite energy density.

BRIEF DESCRIPTION OF THE DRAWINGS

Subject matter is particularly pointed out and distinctly claimed in the concluding portion of the specification. The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

In the drawings.

DETAILED DESCRIPTION

Figure 1:
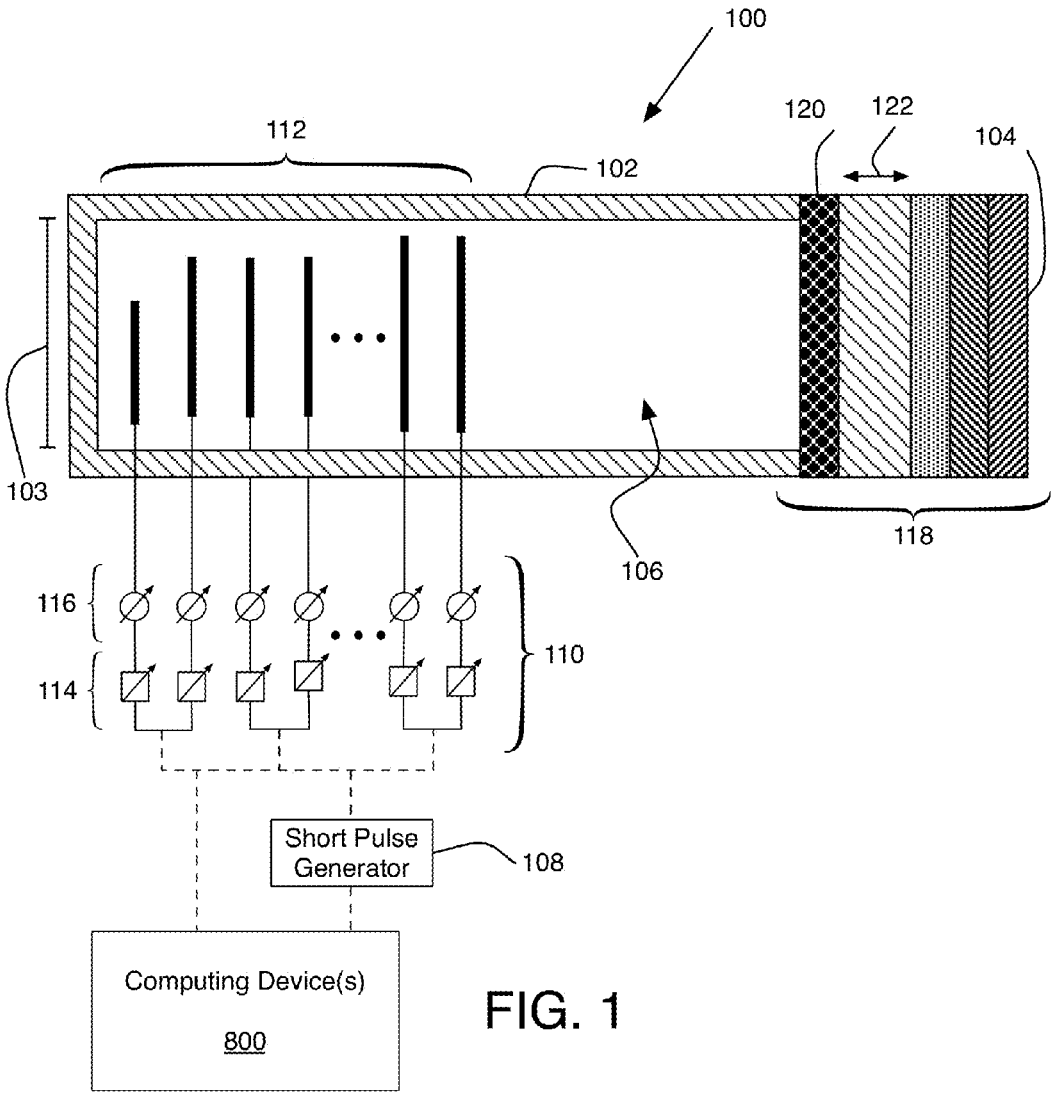
FIG. 1 illustrates a cross-sectional diagram of an example wave launcher.

The following description sets forth various examples along with specific details to provide a thorough understanding of claimed subject matter. It will be understood by those skilled in the art, however, that claimed subject matter may be practiced without some or more of the specific details disclosed herein. Further, in some circumstances, well-known methods, procedures, systems, components and/or circuits have not been described in detail in order to avoid unnecessarily obscuring claimed subject matter. In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and make part of this disclosure.

This disclosure is drawn, inter alia, to methods, apparatus, systems and/or computer program products related to exciting two or more modes via modal decomposition of a pulse by a wave launcher.

FIG. 1 illustrates an example wave launcher 100, in accordance with at least some embodiments of the present disclosure. In the illustrated example, wave launcher 100 may include a wave guide 102. Wave guide 102 may be an elongated member of a generally tubular shape with at least one aperture plane 104 located at an end of wave guide 102. For example, the generally tubular shape of wave guide 102 may be of an elongated member with a round cross-sectional profile (e.g., a round cylindrical tube shape), an elongated member with a rectangular or square cross-sectional profile (e.g., a square tube shape), an elongated member with an oval or elliptical cross-sectional profile (e.g., an oval tube shape) and/or the like. In the illustrated example, wave guide 102 may have a cross-sectional diameter 103 of approximately one and a half cm to approximately three cm, although wave guide 102 may be sized differently depending on variations to the design of wave launcher 100 and/or depending on variations in a spectral bandwidth of a short pulse to be delivered to wave launcher 100.

Wave guide 102 may contain a dielectric material 106. For some examples, dielectric material 106 may be air, however any other low-loss dielectric material may be utilized depending on the design of wave launcher 100. For example, dielectric material 106 may be utilized to improve coupling and/or to reduce reflections from aperture plane 104. In the illustrated example, wave launcher 100 may be capable of exciting and/or supporting many modes of the cylindrical waveguide in terms of electromagnetic waves such as radio frequency waves, microwaves, etc. In one example, wave launcher 100 may be capable of generating electromagnetic waves with a frequency from about eight gigahertz (8 GHz) to about twenty gigahertz (20 GHz). However, other frequencies might be utilized with wave launcher 100, or wave launcher 100 might be altered in size and/or arrangement to be better suited for other frequencies. Alternatively, certain aspects of wave launcher 100 may be adapted for use as an acoustic waveguide, an optical waveguide such as an optical fiber, and/or the like.

Pulse generator 108 may be capable of generating a pulse for use by wave launcher 100. For example, such a pulse may be an electromagnetic pulse, such as in cases where wave launcher 100 may be capable of generating and supporting propagating electromagnetic radio frequency waves. Additionally, such a pulse may be a relatively short pulse in the time domain. As used herein the term "short pulse" may include a pulse from approximately one pico-second to approximately tens of nanoseconds in length, for example.

Pulse generator 108 may be operably coupled to a power divider 110. The short pulse from pulse generator 108 may be received by power divider 110. Power divider 110 may be operably coupled to a plurality of antennas 112. Power divider 110 may be capable of dividing a short pulse from pulse generator 108 among two or more of antennas 112. For example, power divider 110 may include two or more pairs of variable amplitude adjustors 114 and variable phase shifters 116. As used herein the term "amplitude adjustor" may include one or more attenuators, amplifiers, the like, and/or combinations thereof. Such pairs of variable amplitude adjustors 114 and variable phase shifters 116 may be capable of dividing a short pulse from pulse generator 108 among two or more antennas 112. In such a case, power divider 110 may be capable of modifying the power or amplitude of a short pulse from pulse generator 108 among two or more antennas 112, via variable amplitude adjustors 114. Additionally or alternatively, power divider 110 may be capable of modifying a short pulse from pulse generator 108 with a variable phase shift or time delay among two or more antennas 112, via variable phase shifters 116. Power divider 110, variable amplitude adjustors 114, variable phase shifters 116, and/or pulse generator 108 may be manually operated and/or may be associated with one or more controllers, such as one or more computing devices 800, for example. Such one or more computing devices 800 may control the operation and/or adjustment of power divider 110, magnitude of a pulse via variable amplitude adjustors 114, phase shift or time delay of the pulse via variable phase shifters 116, and/or pulse generator 108 to modify parameters of a short pulse from pulse generator 108 in each branch.

As illustrated, antennas 112 may vary in size, one from another. Alternatively, antennas 112 may be of the same or similar size. In the illustrated example, antennas 112 may be spaced approximately one cm to approximately five cm apart from one another. Each of the individual antennas may be positioned within the waveguide at a different distance from the aperture, where the spacing between the antennas may be uniformly spaced (i.e., all spaced apart the same distance) or non-uniformly spaced with respect to one another. In one example, there may be up to sixteen antennas 112, although this is merely an example and other numbers of antennas 112 that may be utilized. Antennas 112 may be oriented and/or arranged in a loop-type arrangement. In some alternatives, antennas 112 may be oriented and/or arranged in a loop or a probe (e.g. dipole-type) arrangement, although other antenna arrangements are also contemplated such as horn, spiral, and/or helical antennas, for example.

Tuning section 118 may include one or more dielectric tuning elements 120 located adjacent the aperture plane end 104 of wave launcher 100. Such dielectric tuning elements 120 may include solid pieces of low-loss dielectric material that may be similar in shape to wave guide cross-section 102. In the illustrated example, tuning section 118 may include any number of dielectric tuning elements 120 of various permittivity values and/or various thicknesses 122 layered against one another. For example, the relative dielectric constant values of dielectric tuning elements 120 may vary in a range from about two (2) to about ten (10). In some examples, dielectric tuning elements 120 may be cylindrical in shape, although other shapes may be suitable based at least in part on the shape of wave guide 102.

Alternatively, tuning section 118 may optionally be excluded from wave launcher 100. In such a case, aperture plane 104 may comprise an opening in wave launcher 100. Aperture plane 104 may be positioned approximately 10 cm from the nearest of antennas 112, although aperture plane 104 may be positioned differently depending on variations to the design and/or operational constraints of wave launcher 100.

In some examples, antennas 112 may be capable of emitting electromagnetic energy from power divider 110 in two or more modes that may be transferred through wave guide 102. As used herein the term "mode" may refer to a mode of operation inside the waveguide 102 for a propagating short pulse. For example, such a "mode" may refer to a particular electromagnetic field pattern of propagating in the waveguide 102, a radiation pattern measured in a plane perpendicular (e.g. transverse) to the propagation direction on the aperture 104, and/or a radiation pattern measured in a far field region of the waveguide 102. Such modes may be Transverse Electric (TE) modes that may have no electric field in the direction of propagation, Transverse Magnetic modes (TM) that may have no magnetic field in the direction of propagation, Transverse Electromagnetic modes (TEM) that have no electric or magnetic fields in the direction of propagation or Hybrid modes, which may have non-zero electric and magnetic fields in the direction of propagation. In one example, a single pulse generated by pulse generator 108 may be divided into two or more of modes of various frequencies by wave launcher 100. Wave guide 102 may be capable of transferring electromagnetic energy emitted from the plurality of antennas 112 in the form of the two or more modes. Individual antennas may correspond to an individual mode or correspond to a superposition of modes excited in the waveguide 102.

A single pulse generated by pulse generator 108 may be divided at power divider 110. Power divider 110 may be capable of dividing a short pulse from pulse generator 108 among two or more antennas 112. Additionally, power divider 110 may be capable of modifying the power or amplitude of a short pulse from pulse generator 108 among two or more antennas 112, via variable amplitude adjustors 114. Similarly, power divider 110 may be capable of modifying a short pulse from pulse generator 108 with a variable phase shift or time delay among two or more antennas 112, via variable phase shifters 116. Such division, amplitude modification, and/or phase shift modification of a pulse generated by pulse generator 108 may be utilized to excite two or modes of wave launcher 100. For example, an individual port (not shown) from the power divider 110 may be associated with a divided portion of a pulse and can be adjusted in amplitude through an amplitude adjustor 114 and in phase through a phase shifter 116 to excite a particular mode or a superposition of modes excited in the wave launcher 100 with a proper amplitude and phase. Additionally or alternatively, depending on the thicknesses 122 and/or permittivity values of dielectric tuning elements 120, tuning section 118 may be capable of adjusting amplitude and/or phase shift of at least one of the two or more modes emitted from wave launcher 100. Such an excitation of two or modes via division, amplitude modification, and/or phase shift modification of a pulse generated by pulse generator 108 may be referred to herein as a "modal decomposition" of such a pulse. Such a modal decomposition of a pulse may result in generation and propagation of a simultaneous superposition of two or more modes of various frequency bands. For example, such a simultaneous superposition of two or more modes of various frequency bands may correspond to propagating modes above cut-off frequencies.

Figure 2:
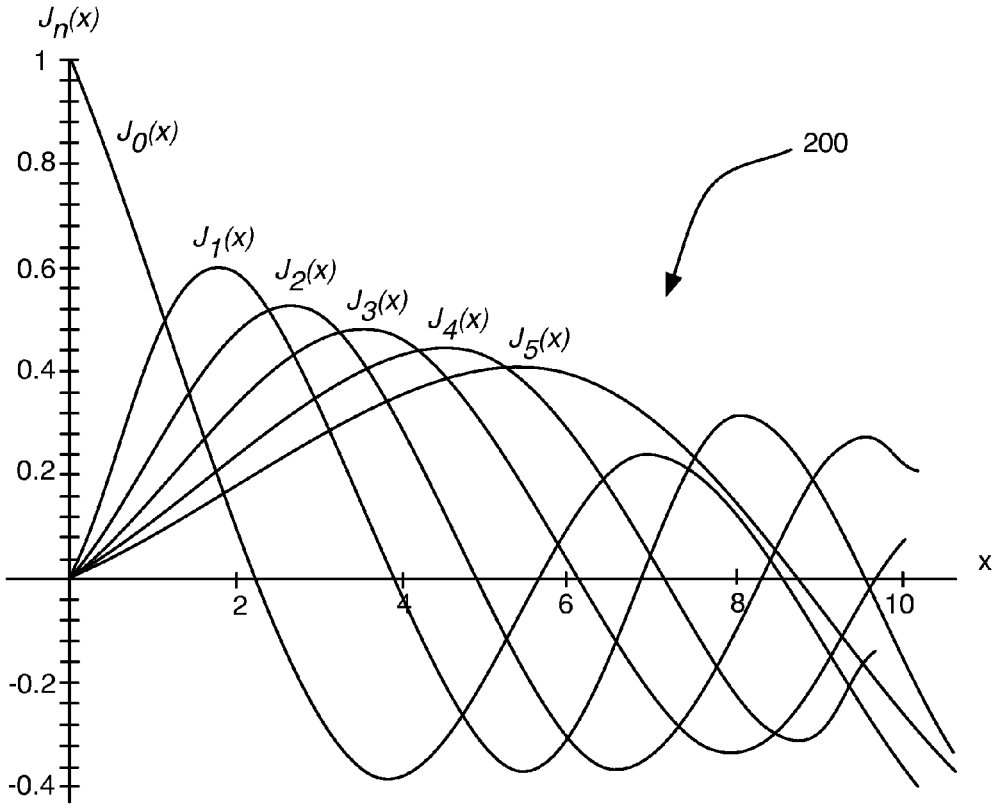
FIG. 2 illustrates a chart of combined Bessel functions as applied to a decomposition of a pulse.

FIG. 2 illustrates a chart 200 of combined Bessel functions as applied to a decomposition of a pulse, in accordance with at least some embodiments of the present disclosure. Such a chart 200 of combined Bessel functions may better illustrate a modal decomposition of a pulse into a superposition of two or more modes of various frequencies. Chart 200 shows a plot of combined Bessel functions $f_n(x)$, where n may be an integer such as n=0, 1, 2, 3, 4, 5, etc., or the like. Such modes may be respectively associated with components ($f_0(x)$, $f1(x)$, etc.) of a combined Bessel function $f_n(x)$. For example, a first mode may be associated with a first component $f_0(x)$ of combined Bessel functions $f_n(x)$, a second mode may be associated with a second component $f_1(x)$ of a combined Bessel function $f_n(x)$, and so on. Such functional dependence may not be limited to Bessel's functions depending on the type and/or excitation properties of a given waveguide.

Figure 3:
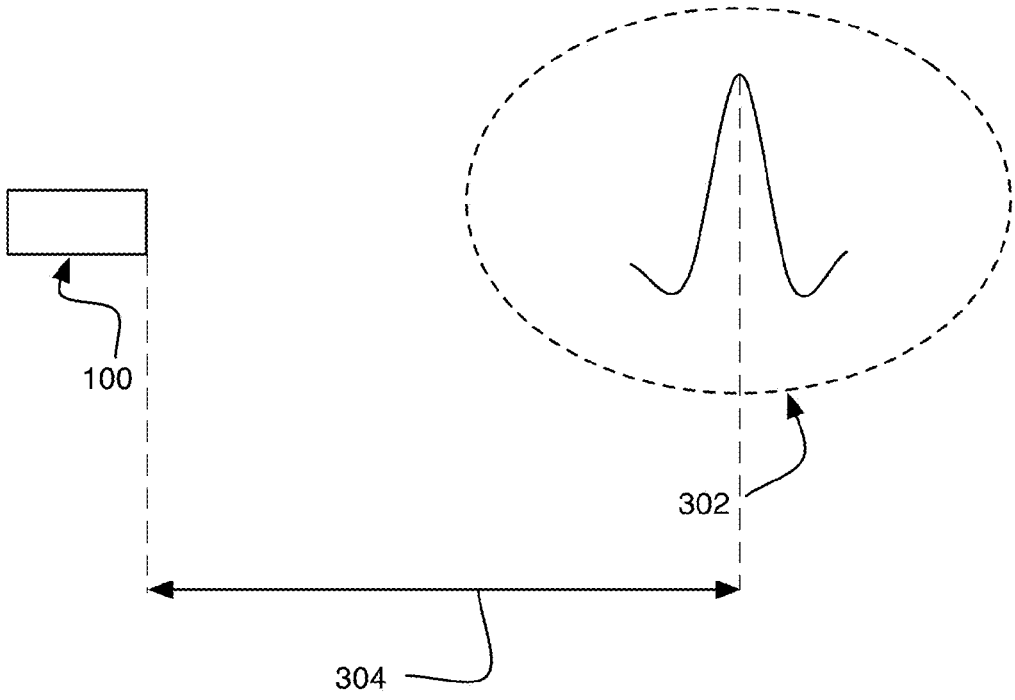
FIG. 3 illustrates a diagram of a wave launcher in operation.

FIG. 3 illustrates a diagram of a wave launcher 100 in operation, in accordance with at least some embodiments of the present disclosure. The two or more modes of various frequencies generated by wave launcher 100 may form a combined peak 302. For example, wave launcher 100 may be capable of generating a peak 302 of a localized wave at a given distance 304 from wave launcher 100 based at least in part on such two or more modes. More specifically, aperture fields may be synthesized at the aperture plane 104 of wave launcher 100 based at least in part on such two or more modes in such a manner that peak 302 of such a localized wave will be observable at a given distance 304 from wave launcher 100.

Between the position of wave launcher 100 and peak 302, the two or more modes generated by wave launcher 100 may not combine in a significant way. For example, the two or more modes associated with various components of a combined Bessel function (see FIG. 2) may be out of sync with one another until generating a peak 302 of a localized wave at a given distance 304 from wave launcher 100.

Additionally, wave launcher 100 may be adjusted so as to observe a peak 302 at a predetermined distance 304. For example, tuning the magnitudes and/or phases of the propagating modes of the pulse delivered to the antennas 112 (FIG. 1) via power divider 110 (FIG. 1) and synthesizing the proper aperture distribution at the aperture plane 104 of wave launcher 100 may alter the distance 304 at which a peak 302 may be observed. Additionally or alternatively, tuning section 118 (FIG. 1) may include any number of dielectric tuning elements 120 (FIG. 1) of various permittivity values and/or various thicknesses 122 (FIG. 1). Variations in the number, thicknesses, and/or permittivity of dielectric tuning elements 120 (FIG. 1) may alter the distance 304 at which a peak 302 may be observed.

Figure 4:
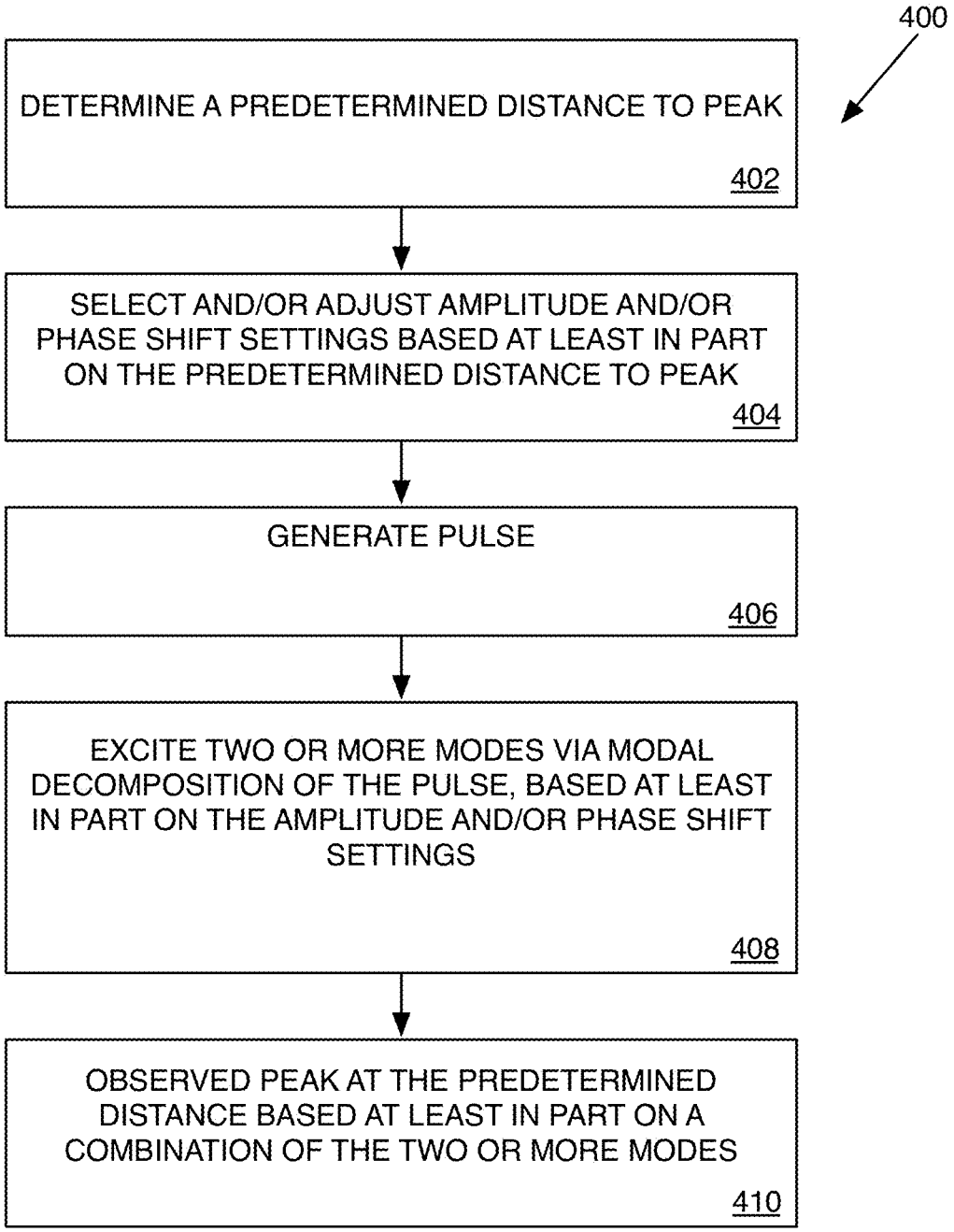
FIG. 4 illustrates an example process for exciting two or more modes via modal decomposition of a pulse by a wave launcher.

FIG. 4 illustrates an example process 400 for exciting two or more modes via modal decomposition of a pulse by a wave launcher, in accordance with at least some embodiments of the present disclosure. Process 400, and other processes described herein, set forth various functional blocks or actions that may be described as processing steps, functional operations, events and/or acts, etc., which may be performed by hardware, software, and/or firmware. Those skilled in the art in light of the present disclosure will recognize that numerous alternatives to the functional blocks shown in FIG. 4 may be practiced in various implementations. For example, although process 400, as shown in FIG. 4, comprises one particular order of blocks or actions, the order in which these blocks or actions are presented does not necessarily limit claimed subject matter to any particular order. Likewise, intervening actions not shown in FIG. 4 and/or additional actions not shown in FIG. 4 may be employed and/or some of the actions shown in FIG. 4 may be eliminated, without departing from the scope of claimed subject matter. Process 400 may include one or more of blocks 402, 404, 406, 408 and/or 410.

As illustrated, control process 400 may be implemented to excite two or more modes via modal decomposition of a pulse by a wave launcher 100 (FIG. 1). At block 402, a predetermined distance to a localized peak may be determined using algorithms based on theoretical formulations and/or numerical simulations. For example, a predetermined distance to a localized peak may be determined by measuring a corresponding pulse distribution at a target location (e.g. at a distance 304 at which a peak 302 is desired, see FIG. 3). However, storage of historical data from previous experiments to measure the corresponding pulse distribution at one or more target locations may serve as a guide or check for determining the predetermined distance to the localized peak. At block 404, amplitude and/or phase shift settings may be selected and/or adjusted. As discussed above with respect to FIG. 1, such an adjustment in amplitude may be performed through amplitude adjustor 114 and in phase may be performed through phase shifter 116. For example, amplitude and/or phase shift settings may be adjusted based at least in part on the predetermined distance to peak. At block 406 a pulse may be generated. As discussed above with respect to FIG. 1, such a pulse may be generated via pulse generator 108. At block 408, two or more modes may be excited via modal decomposition of the pulse. As discussed above with respect to FIG. 1, such an excitation of two or more modes may be performed via antennas 112. Such an excitation of two or more modes may in turn synthesize a desired aperture field to produce the localized wave peak at the predetermined distance. Other mechanisms may be utilized for such excitation, including those illustrated in FIGS. 5 and 6. For example, two or more modes may be exited via modal decomposition of the pulse in wave launcher 100 (FIG. 1), based at least in part on the amplitude and/or phase shift settings. At block 410, the localized peak may be observed at the predetermined distance. In some examples, the localized peak may be observed at the predetermined distance either by physically observable results measurements or by placing sensors at the localized peak location to observe the presence and the intensity of the excited localized wave. For example, the localized peak may be observed at the predetermined distance from wave launcher 100 (FIG. 1) based at least in part on a synthesis of the aperture field due to a combination of the two or more modes radiated from the aperture plane based on theoretical formulation and/or numerical simulations. The number of antennas may be directly proportional to the number of modes used in the synthesis of the aperture field. For example, each antenna may be associated with each mode or a superposition of all modes chosen to synthesize a desired aperture distribution.

For example, referring back to FIG. 3, in an example use of wave launcher 100 for destructive purposes, the two or more modes may pass relatively harmlessly from wave launcher 100 along distance 304. In such a case, however, at distance 304 from wave launcher 100, a peak 302 of destructive capability may be observed from the constructive combination of the two or more modes. For example, wave launcher 100 may generating a peak 302 as an electromagnetic pulse directed at an Improvised Explosive Device (IED) (not shown) in such a manner that maximum energy may be imparted onto/into the IED and not its surroundings. Accordingly, a space/time localized peak 302 in the form of an electromagnetic pulse may be synthesized at a distance 304 from the location of an IED. Such a space/time localized peak 302 in the form of an electromagnetic pulse may be realized through the effect(s) of a number of antennas 112 excited with a plurality of modes that may cover a bandwidth sufficient to produce a localized wave. Consequently, once an IED is detected and its approximate location is determined, the wave launcher 100 may be adjusted to produce a localized peak of relatively high intensity at that location. Such a localized peak may destroys/deactivates such an IED. Inasmuch as the highest intensity of such a localized peak may be produced at the specific location of the IED, adjacent structures and/or materials may be minimally affected. The combination of the two or more modes emitted from wave launcher 100 may be combined in a Bessel-like manner (see FIG. 2) such their combination may be greatest distance 304 at the location of the IED.

In other examples wave launcher 100 may be utilized for other destructive purposes and/or non-destructive purposes. For example, wave launcher 100 may be utilized for data transmission and/or the like. Fields emitted by wave launcher 100 may synthesize the pulse only at the predetermined location due to constructive interference of the modes that synthesized the aperture field. At other locations, the fields produced by wave launcher 100 due to destructive interference of these modes may produce relatively low intensities, thus making the fields produced at such other locations almost undetectable. Therefore, wave launcher 100 may be used as a secure communication device to deliver messages only to the predetermined location. Design parameters may be chosen accordingly to produce localized waves at such a pre-determined location.

Figure 5:
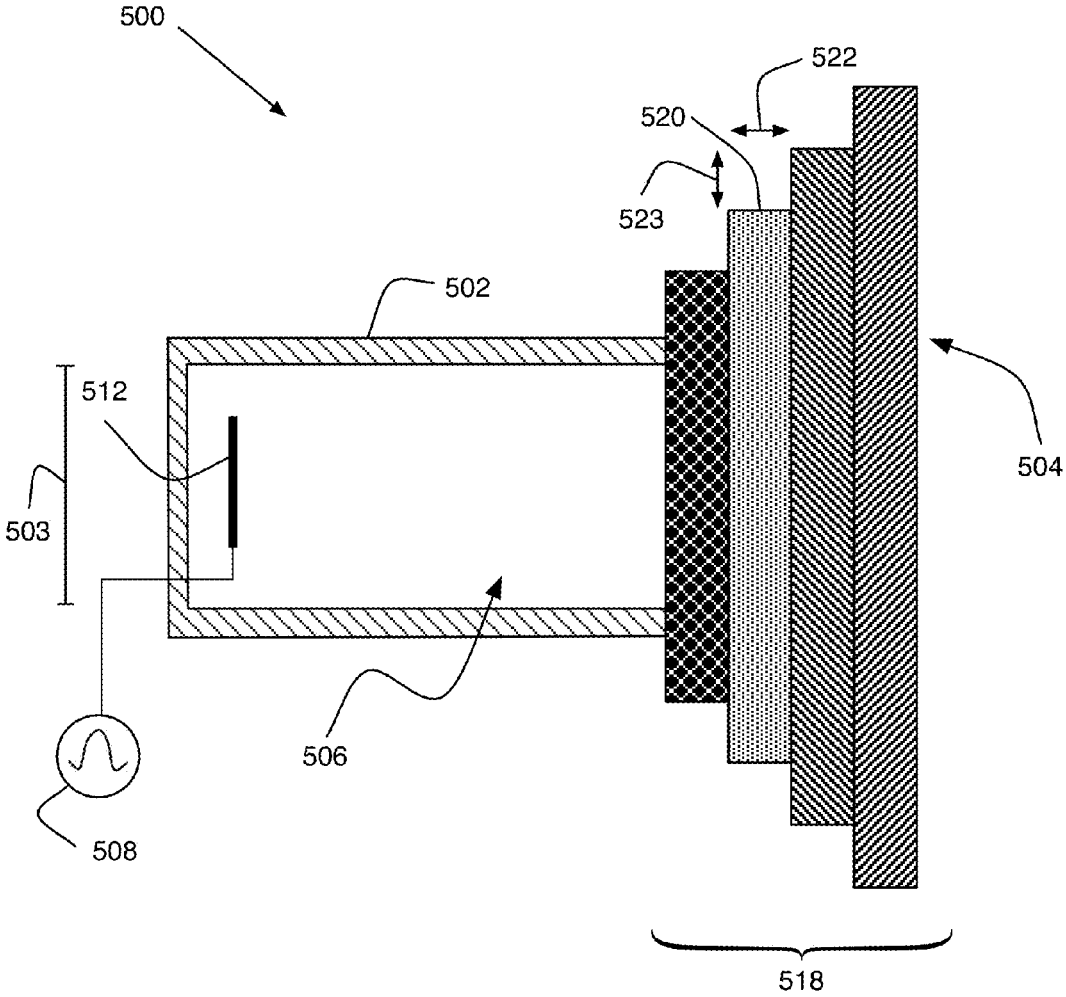
FIG. 5 illustrates a cross-sectional diagram of an example of another type of wave launcher.

FIG. 5 illustrates an example of another type of wave launcher 500, in accordance with at least some embodiments of the present disclosure. In the illustrated example, wave launcher 500 may include a wave guide 502 that may be an elongated member of a generally tubular shape. In the illustrated example, wave guide 502 may have a diameter 503 of approximately one and a half cm to approximately three cm, although wave guide 502 may be sized differently depending on variations to the design of wave launcher 500. Wave guide 502 may contain a dielectric material 506, such as air or any other low-loss dielectric material, for example. Pulse generator 508 may be capable of generating an electromagnetic pulse for use by wave launcher 500. Pulse generator 508 may be operably coupled to a single antenna 512 to be capable of emitting electromagnetic energy from the pulse generator. In such a case antenna 512 may be capable of exciting a fundamental mode that may be transferred through wave guide 502. Antenna 512 may be oriented and/or arranged in a loop-type arrangement. Alternatively, antenna 512 may be a loop or a probe (e.g. dipole-type) oriented at a specific location from the short circuits end of the wave guide 502. Changing cross-sections of the successive portions of step stage section 518 of the wave launcher 500 may result in excitation of higher order modes capable of propagating in the wave launcher 500. For example, an individual step stage element 520 may form a discontinuity within the wave guide 502 resulting in exciting a higher order mode. Modes incident at such a discontinuity may result in a higher order mode past the changing cross-section that forms the discontinuity. A cross-section height 523 dimensions of the step stage element 520 may control the amplitude, whereas the thicknesses 522 of the step stage element 520 may adjust the phase of the excited higher order mode. Successive elements of step stage section 518 may be designed to excite the desired number of higher order modes with the proper amplitude and/or phase to synthesize the desired aperture field distribution of the wave launcher 500.

Step stage section 518 may include two or more successive step stage elements 520 with variable cross-sections and/or lengths. Such step stage elements 520 may include dielectric materials. The presence of such dielectric materials may help to reduce the physical dimensions of the wave launcher 500, improve gain, and/or reduce reflections within the wave launcher 500. Physical dimensions and dielectric permittivities may be selected so as to synthesize the desired aperture field distribution on an aperture plane end 504 of wave launcher 500. Such step stage section 518 may include solid pieces of low-loss dielectric material that may fill fully or partially the extension of wave guide 502. In the illustrated example, step stage section 518 may include two or more successive dielectric step stage elements 520 of various permittivity values, various heights 523 and/or various thicknesses 522 layered against one another. For example, the permittivity values of dielectric step stage elements 520 may vary in a range from about two to about ten as a ratio of linear permittivity relative to that of free space. In some examples, dielectric step stage elements 520 may be cylindrical in shape, although other shapes may be suitable based at least in part on the shape of wave guide 502.

In the illustrated example, step stage section 518 may include two or more successive dielectric step stage elements 520 of various heights 523 and/or various thicknesses 522 so as to form a generally tapered corrugated shape. Such a tapered section 518 may be smallest in cross-section near wave guide 502 and largest in cross-section on the aperture plane end 504 of wave launcher 502. Additionally or alternatively, such a tapered step stage section 518 may be of a generally piece-wise stepped shape (as illustrated), a generally frusto-conical shaped, exponential shaped and/or the like.

Such two or more successive step stage elements 520 may be capable of exciting two or more higher order modes from the electromagnetic energy emitted from the antenna 512 comprising of a fundamental mode only. For example, such two or more dielectric step stage elements 520 may be capable of modifying the fundamental mode emitted from antenna 512 into two or more higher order modes by adjusting the corresponding amplitudes and/or phases while the fundamental mode still propagates in the launcher. More specifically, the tapered shape of step stage section 518 may excite higher order modes from the fundamental mode emitted from antenna 512. As the tapered section 518 broadens, higher order modes may be excited where the height 523 may adjust the amplitude and the thickness 522 together with the permittivity value may adjust the phase shift of such higher order modes. The step stage elements 520 (or the number of steps in the tuning section 518) may be determined based at least in part on the broadband nature of selected pulse generated by pulse generator 508. Accordingly, the tapered step stage section 518 may be oriented and arranged to achieve proper amplitude and phase shift for two or more modes at the aperture plane 504 to synthesize a peak 302 (FIG. 3) of a localized wave at a given distance 304 (FIG. 3) from the wave launcher 500.

Figure 6:
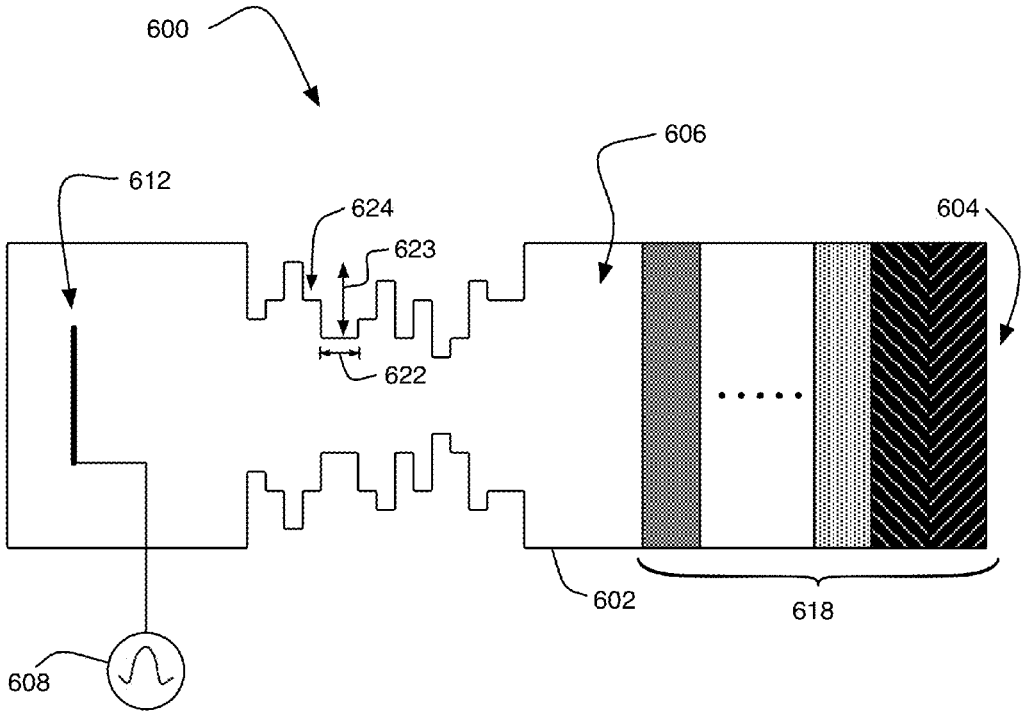
FIG. 6 illustrates a cross-sectional diagram of an example of another type of wave launcher.

FIG. 6 illustrates an example of another type of wave launcher 600, in accordance with at least some embodiments of the present disclosure. In the illustrated example, wave launcher 600 may include a wave guide 602 that may be an elongated member of a generally tubular shape. In the illustrated example, wave guide 602 may have a diameter of approximately one and a half cm to approximately three cm, although wave guide 602 may be sized differently depending on variations to the design of wave launcher 600. Wave guide 602 may contain a dielectric material 606, such as air or any other low-loss dielectric material for example. Pulse generator 608 may be capable of generating an electromagnetic pulse for use by wave launcher 600. Pulse generator 608 may be operably coupled to an antenna 612, which is capable of emitting electromagnetic energy responsive to excitation energy from the pulse generator. In such a case antenna 612 may be capable of exciting a fundamental mode into the wave guide 602. Antenna 612 may be oriented and/or arranged in a loop-type arrangement. Alternatively, antenna 612 may be oriented and/or arranged in a loop or a probe (e.g. dipole-type) arrangement. Tuning section 618 may include one or more dielectric tuning elements 620 located adjacent an aperture plane end 604 of wave launcher 600. Alternatively, tuning section 618 may optionally be excluded from wave launcher 600. In such a case, aperture plane 604 may comprise an opening in wave launcher 600.

A corrugated section 624 may be located within the wave guide 602. Such a, corrugated section 624 functioning as a mode converter may be capable of exciting two or more higher order modes from the electromagnetic energy emitted from the antenna 612. For example, as a fundamental mode emitted from the antenna 612 is incident on corrugated section 624, higher order modes may be excited. In the illustrated example, corrugated section 624 may include two or more corrugations of various depths 623 and/or various lengths 622 positioned adjacent to one another within a corrugated section. In such a case, the depth 623 and/or the length 622 of individual corrugations of corrugated section 624 may determine the amplitude and/or phase shift of such higher order modes. Initial energy due to a short pulse in the fundamental mode may be converted into higher order modes, which in turn may synthesize proper aperture distribution to generate a peak 302 (FIG. 3) of a localized wave at a given distance 304 (FIG. 3) from the wave launcher 600.

Such a corrugated section 624 may be capable of exciting two or more modes from the electromagnetic energy emitted from the antenna 612. For example, such a corrugated section 624 may be capable of modifying the fundamental mode emitted from antenna 612 into two or more higher order modes upon incidence on the discontinuities of the corrugated section 624 and individual modes in terms of amplitudes and phases may be adjusted via the depth 623 and/or the length 622 of the corrugated section 624. The variations in depth 623 and/or the length 622 of the corrugated section 624 may be determined based at least in part on the broadband nature of selected pulse generated by pulse generator 608. Accordingly, the corrugated section 624 may be oriented and arranged to achieve proper amplitude and phase shift for two or more modes at the aperture plane 604 to synthesize a peak 302 (FIG. 3) of a localized wave at a given distance 304 (FIG. 3) from the wave launcher 600.

Figure 7:
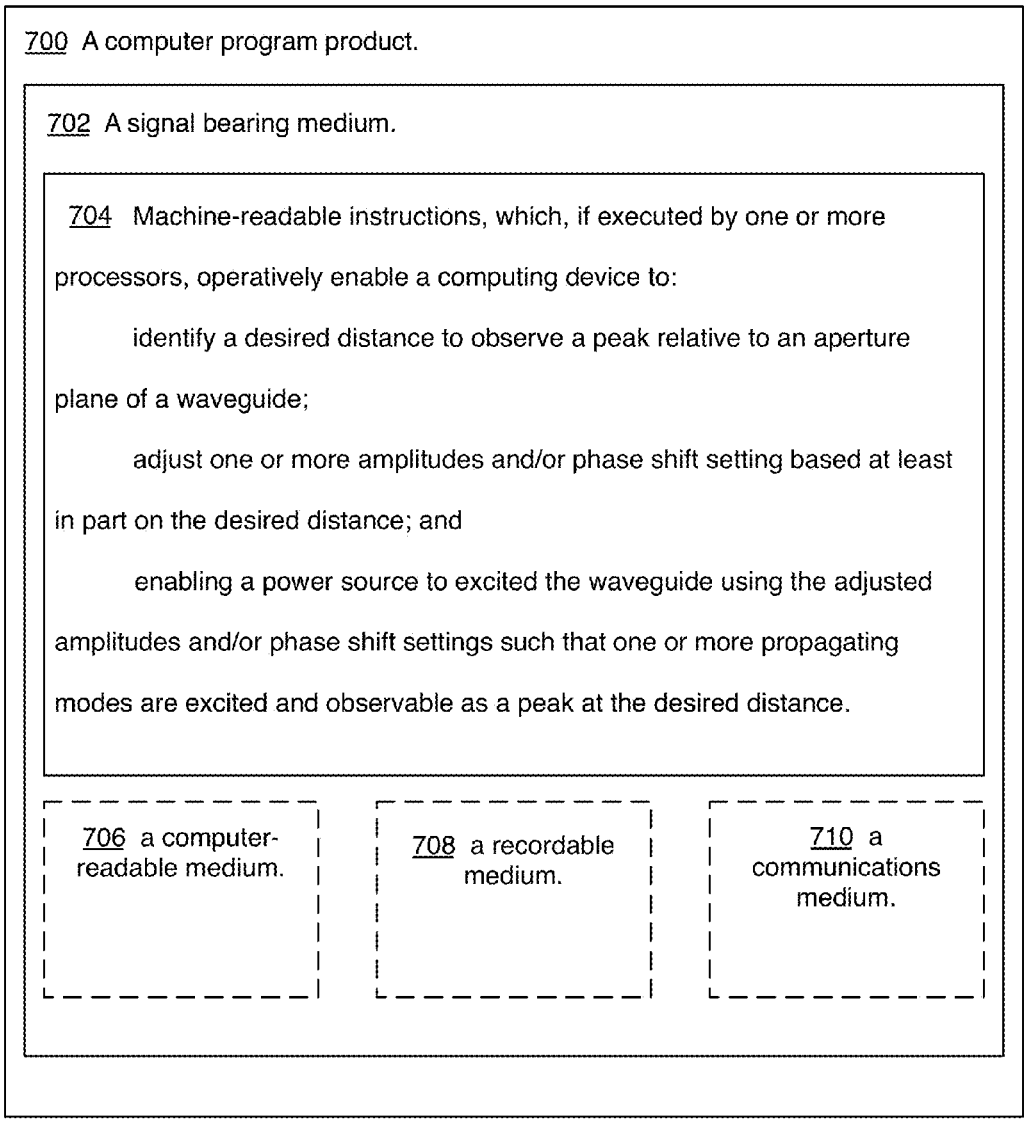
FIG. 7 illustrates an example computer program product.

FIG. 7 illustrates an example computer program product 700 that is arranged in accordance with the present disclosure. Program product 700 may include a signal bearing medium 702. Signal bearing medium 702 may include one or more machine-readable instructions 704, which, if executed by one or more processors, may operatively enable a computing device to provide the functionality described above with respect to FIG. 4. Thus, for example, referring to the system of FIG. 1, wave launcher 100 may undertake one or more of the actions shown in FIG. 4 in response to instructions 704 conveyed by medium 702.

In some implementations, signal bearing medium 702 may encompass a computer-readable medium 706, such as, but not limited to, a hard disk drive, a Compact Disc (CD), a Digital Video Disk (DVD), a digital tape, memory, etc. In some implementations, signal bearing medium 702 may encompass a recordable medium 708, such as, but not limited to, memory, read/write (R/W) CDs, R/W DVDs, etc. In some implementations, signal bearing medium 702 may encompass a communications medium 710, such as, but not limited to, a digital and/or an analog communication medium (e.g., a fiber optic cable, a waveguide, a wired communications link, a wireless communication link, etc.).

Figure 8:
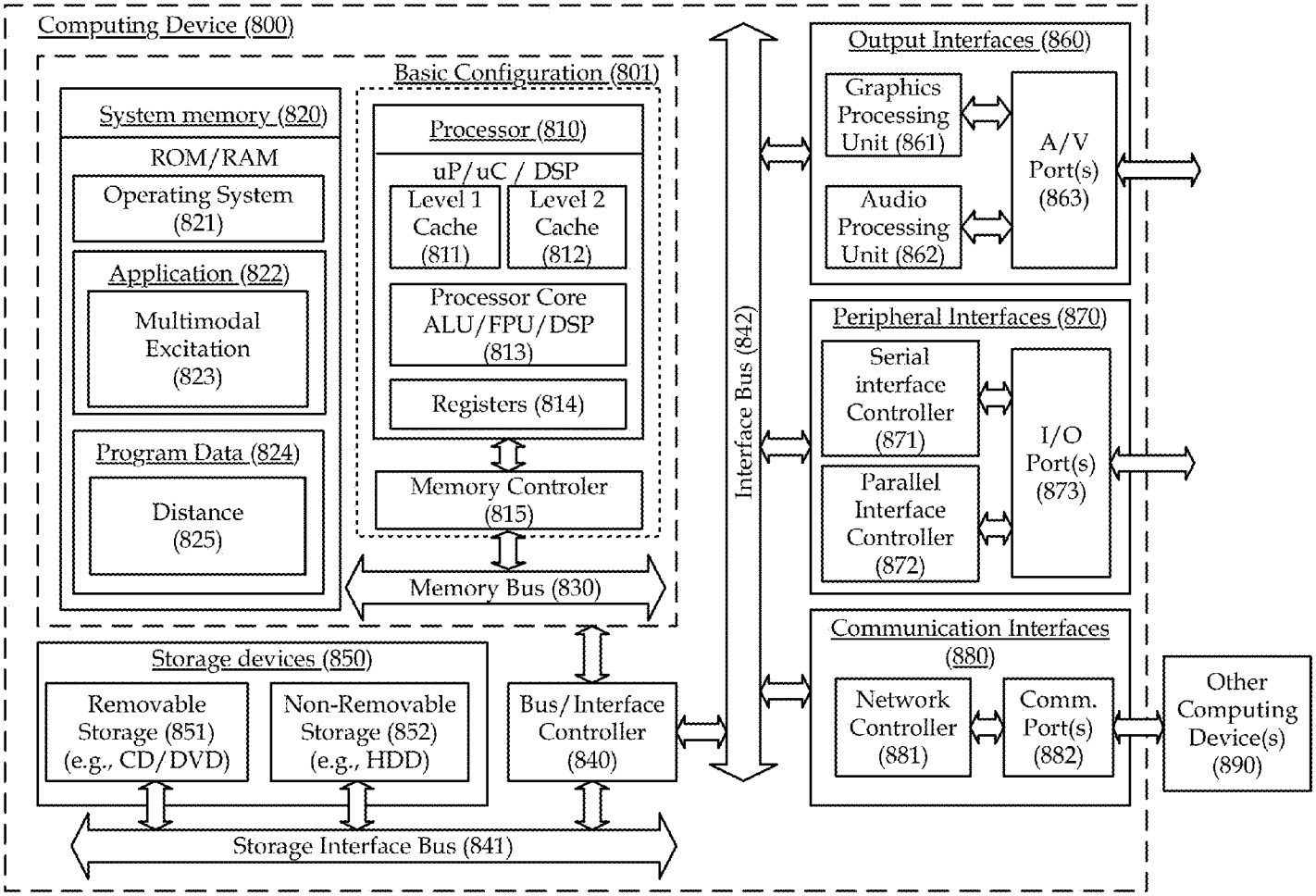
FIG. 8 is a block diagram illustrating an example computing device, all arranged in accordance with the present disclosure.

FIG. 8 is a block diagram illustrating an example computing device 800 that is arranged in accordance with the present disclosure. In one example configuration 801, computing device 800 may include one or more processors 810 and system memory 820. A memory bus 830 can be used for communicating between the processor 810 and the system memory 820.

Depending on the desired configuration, processor 810 may be of any type including but not limited to a microprocessor (μP), a microcontroller (μC), a digital signal processor (DSP), or any combination thereof. Processor 810 can include one or more levels of caching, such as a level one cache 811 and a level two cache 812, a processor core 813, and registers 814. The processor core 813 can include an arithmetic logic unit (ALU), a floating point unit (FPU), a digital signal processing core (DSP Core), or any combination thereof. A memory controller 815 can also be used with the processor 810, or in some implementations the memory controller 815 can be an internal part of the processor 810.

Depending on the desired configuration, the system memory 820 may be of any type including but not limited to volatile memory (such as RAM), non-volatile memory (such as ROM, flash memory, etc.) or any combination thereof. System memory 820 may include an operating system 821, one or more applications 822, and program data 824. Application 822 may include a multimodal excitation via modal decomposition algorithm 823 in a wave launcher that is arranged to perform the functions as described herein including the functional blocks and/or actions described with respect to process 400 of FIG. 4. Program Data 824 may include data 825 for use in multimodal excitation algorithm 823, for example, data corresponding to an indication of a distance from a target object to a wave launcher. Program Data 824 may also include settings such as amplitudes and/or phases for excitation of various antenna elements in some example waveguides. Program Data 824 may further include identification of various propagating modes for transmission by an example waveguide. In some example embodiments, application 822 may be arranged to operate with program data 824 on an operating system 821 such that implementations of multimodal excitation may be provided as described herein. This described basic configuration is illustrated in FIG. 8 by those components within dashed line 801.

Computing device 800 may have additional features or functionality, and additional interfaces to facilitate communications between the basic configuration 801 and any required devices and interfaces. For example, a bus/interface controller 840 may be used to facilitate communications between the basic configuration 801 and one or more data storage devices 850 via a storage interface bus 841. The data storage devices 850 may be removable storage devices 851, non-removable storage devices 852, or a combination thereof. Examples of removable storage and non-removable storage devices include magnetic disk devices such as flexible disk drives and hard-disk drives (HDD), optical disk drives such as compact disk (CD) drives or digital versatile disk (DVD) drives, solid state drives (SSD), and tape drives to name a few. Example computer storage media may include volatile and nonvolatile, removable and non-removable media implemented in any method or technology for storage of information, such as computer readable instructions, data structures, program modules, or other data.

System memory 820, removable storage 851 and non-removable storage 852 are all examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which may be used to store the desired information and which may be accessed by computing device 800. Any such computer storage media may be part of device 800.

Computing device 800 may also include an interface bus 842 for facilitating communication from various interface devices (e.g., output interfaces, peripheral interfaces, and communication interfaces) to the basic configuration 801 via the bus/interface controller 840. Example output interfaces 860 may include a graphics processing unit 861 and an audio processing unit 862, which may be configured to communicate to various external devices such as a display or speakers via one or more NV ports 863. Example peripheral interfaces 860 may include a serial interface controller 871 or a parallel interface controller 872, which may be configured to communicate with external devices such as input devices (e.g., keyboard, mouse, pen, voice input device, touch input device, etc.) or other peripheral devices (e.g., printer, scanner, etc.) via one or more I/O ports 873. An example communication interface 880 includes a network controller 881, which may be arranged to facilitate communications with one or more other computing devices 890 over a network communication via one or more communication ports 882. A communication connection is one example of a communication media. Communication media may typically be embodied by computer readable instructions, data structures, program modules, or other data in a modulated data signal, such as a carrier wave or other transport mechanism, and may include any information delivery media. A "modulated data signal" may be a signal that has one or more of its characteristics set or changed in such a manner as to encode information in the signal. By way of example, and not limitation, communication media may include wired media such as a wired network or direct-wired connection, and wireless media such as acoustic, radio frequency (RF), infrared (IR) and other wireless media. The term computer readable media as used herein may include both storage media and communication media.

Computing device 800 may be implemented as a portion of a small-form factor portable (or mobile) electronic device such as a cell phone, a personal data assistant (PDA), a personal media player device, a wireless web-watch device, a personal headset device, an application specific device, or a hybrid device that includes any of the above functions. Computing device 800 may also be implemented as a personal computer including both laptop computer and non-laptop computer configurations. In addition, computing device 800 may be implemented as part of a wireless base station or other wireless system or device.

Some portions of the foregoing detailed description are presented in terms of algorithms or symbolic representations of operations on data bits or binary digital signals stored within a computing system memory, such as a computer memory. These algorithmic descriptions or representations are examples of techniques used by those of ordinary skill in the data processing arts to convey the substance of their work to others skilled in the art. An algorithm is here, and generally, is considered to be a self-consistent sequence of operations or similar processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals or the like. It should be understood, however, that all of these and similar terms are to be associated with appropriate physical quantities and are merely convenient labels. Unless specifically stated otherwise, as apparent from the following discussion, it is appreciated that throughout this specification discussions utilizing terms such as "processing," "computing," "calculating," "determining" or the like refer to actions or processes of a computing device, that manipulates or transforms data represented as physical electronic or magnetic quantities within memories, registers, or other information storage devices, transmission devices, or display devices of the computing device.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In some embodiments, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a flexible disk, a hard disk drive (HDD), a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link, etc.).

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While certain exemplary techniques have been described and shown herein using various methods and systems, it should be understood by those skilled in the art that various other modifications may be made, and equivalents may be substituted, without departing from claimed subject matter. Additionally, many modifications may be made to adapt a particular situation to the teachings of claimed subject matter without departing from the central concept described herein. Therefore, it is intended that claimed subject matter not be limited to the particular examples disclosed, but that such claimed subject matter also may include all implementations falling within the scope of the appended claims, and equivalents thereof.

What is claimed:

1. A wave launcher arranged to emit two or more modes of propagating waves for observation at a predetermined distance from the wave launcher, comprising:

a pulse generator configured to generate a pulse;

a waveguide including an elongated member and an aperture plane at an end of the waveguide; and a plurality of antennas, each of the plurality of antennas being positioned within the waveguide at a different distance from the aperture plane and arranged such that each of the plurality of antennas is capable of emitting a different mode or a different superposition of modes of propagating wave from the aperture end of the waveguide when excited by the pulse.

2. The wave launcher of claim 1, wherein the elongated member of the wave guide comprises a generally tubular shape.

3. The wave launcher of claim 2, wherein the elongated member of the wave guide has a cross-sectional profile that is either round, oval, rectangular, or square.

4. The wave launcher of claim 1, wherein spacing between the plurality of antennas is either uniformly spaced or non-uniformly spaced with respect to one another.

5. The wave launcher of claim 1, the plurality of antennas comprising two or more differently sized antennas.

6. The wave launcher of claim 1, further comprising a power divider that is operably coupled to the plurality of antennas, operably coupled to the pulse generator, and arranged to divide the pulse among two or more of the plurality of antennas.

7. The wave launcher of claim 6, wherein the power divider comprises two or more sets of variable amplitude adjustors and variable phase shifters.

8. The wave launcher of claim 1, further comprising a tuning section located adjacent the aperture plane of the waveguide, the tuning section comprising two or more dielectric tuning elements capable of adjusting amplitude and/or phase shift of at least one of the two or more modes of propagating waves.

9. A wave launcher arranged to emit two or more modes of propagating waves for observation at a predetermined distance from the wave launcher, comprising:

a pulse generator configured to generate a pulse;

a wave guide including an elongated member with an aperture plane located at an end of the waveguide;

an antenna positioned within the waveguide at a distance from the aperture plane and arranged such that the antenna is capable of emitting electromagnetic energy to the aperture end of the waveguide when excited the pulse; and a step stage section located adjacent the aperture plane of the waveguide, the step stage section comprising two or more dielectric step stage elements capable of exciting two or more modes of propagating waves from the wave launcher in response to the emitted electromagnetic energy from the antenna.

10. The wave launcher of claim 9, wherein the elongated member of the wave guide comprises a generally tubular shape.

11. The wave launcher of claim 9, wherein the two or more dielectric step stage elements are capable of adjusting amplitude and/or phase shift of at least one of the two or more modes of propagating waves.

12. The wave launcher of claim 9, wherein the step stage section comprises a stepped horn shape.

13. A wave launcher arranged to emit two or more modes of propagating waves for observation of a localized wave peak at a predetermined distance from the wave launcher, comprising:

a pulse generator configured to generate a pulse;

a wave guide including an elongated member with an aperture plane located at an end of the waveguide;

an antenna positioned within the waveguide at a distance from the aperture plane and arranged such that the antenna is capable of emitting electromagnetic energy to the aperture end of the waveguide when excited the pulse; and a corrugated section located within the wave guide, the corrugated section being capable of exciting two or more modes of propagating waves from the wave launcher in response to the emitted electromagnetic energy from the antenna.

14. The wave launcher of claim 13, wherein the elongated member of the wave guide comprises a generally tubular shape.

15. The wave launcher of claim 13, further comprising a tuning section located adjacent an aperture plane end of the wave launcher, the tuning section comprising two or more dielectric tuning elements capable of adjusting amplitude and/or phase shift of at least one of the two or more modes of propagating waves.

* * * * *

UNITED STATES PATENT AND TRADEMARK OFFICE

CERTIFICATE OF CORRECTION

PATENT NO. : 8,587,490 B2
APPLICATION NO. : 12/510040
DATED : November 19, 2013
INVENTOR(S) : Niver et al.

It is certified that error appears in the above-identified patent and that said Letters Patent is hereby corrected as shown below:

On the Title Page, in Item (75), under "Inventors", in Column 1, Line 2, delete "Mohamed Salem," and insert -- Mohamed A. Salem, --, therefor.

In the Specification:

In Column 11, Line 26, delete "NV" and insert -- A/V --, therefor.

In the Claims:

In Column 15, Line 4, in Claim 9, delete "excited the" and insert -- excited by the --, therefor.

In Column 16, Line 7, in Claim 13, delete "excited the" and insert -- excited by the --, therefor.

Signed and Sealed this
Twenty-seventh Day of May, 2014

Michelle K. Lee

Michelle K. Lee
*Deputy Director of the United States Patent and Trademark Office*